United States Patent [19]

Spain et al.

[11] Patent Number: 4,984,502

[45] **Date of Patent: * Jan. 15, 1991**

[54] APPARATUS AND METHOD FOR BRAIDING FIBER STRANDS AND STUFFER FIBER STRANDS

[75] Inventors: Raymond G. Spain, Farmington Hills; Carlos Bailey, Farmington, both of Mich.

[73] Assignee: Airfoil Textron Inc., Lima, Ohio

[ * ] Notice: The portion of the term of this patent subsequent to May 8, 2007 has been disclaimed.

[21] Appl. No.: 191,564

[22] Filed: May 9, 1988.

[51] Int. Cl.[5] ..... D04C 1/06; D04C 3/00

[52] U.S. Cl. ..... 87/8; 87/1; 87/5; 87/7; 87/11; 87/33; 87/34; 139/11; 156/148

[58] Field of Search ..... 87/1, 5, 7, 8, 9, 11, 87/33, 34; 139/11, 13 R, 16; 156/148, 149

[56] References Cited

U.S. PATENT DOCUMENTS

| | | | |
|---|---|---|---|
| 3,426,804 | 2/1969 | Bluck | 139/11 |
| 4,312,261 | 1/1982 | Florentine | 87/33 |
| 4,621,560 | 11/1986 | Brown et al. | 87/8 |
| 4,719,837 | 1/1988 | McConnell et al. | 87/8 X |
| 4,753,150 | 6/1988 | Brown | 87/33 |

OTHER PUBLICATIONS

Richard T. Brown, "Application of Through-The--Thickness Braiding Technology", 3/19-21/85, p. 1509.

*Primary Examiner*—John Petrakes

*Attorney, Agent, or Firm*—Reising, Ethington, Barnard, Perry & Milton

[57] ABSTRACT

The apparatus includes a plurality of fiber strand carrier members that are movable on a carrier surface defined by multiple, movable, side-by-side support members and a plurality of fiber guides affixed on the support members for dispensing axial stuffer fiber strands as the carrier members move along predetermined paths to intertwine the fiber strands from the fiber guides. The carrier members are disposed on the support members for movement therewith and for movement from one support member to abother. The fiber guides are affixed on the support members for movement only with the respective support member. The stuffer fiber strand for each fiber guide is dispensed from a spool that is carried on a respective support member or is mounted on a stationary base.

12 Claims, 10 Drawing Sheets

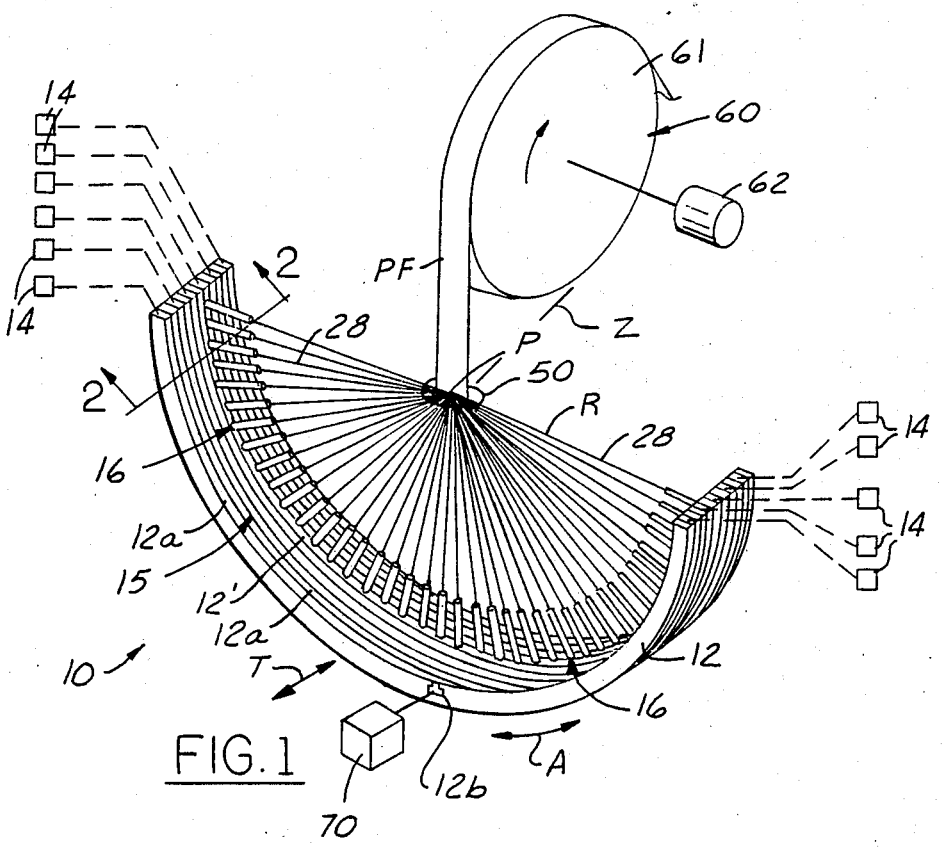
FIG. 1
FIG. 2
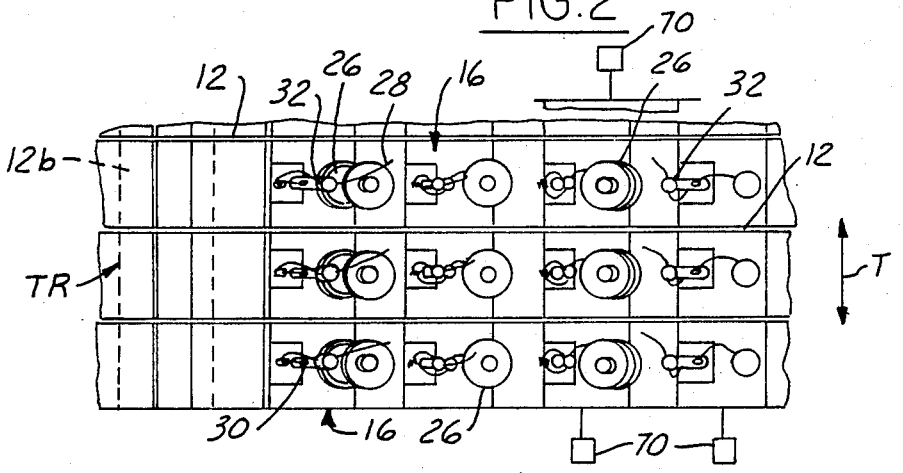

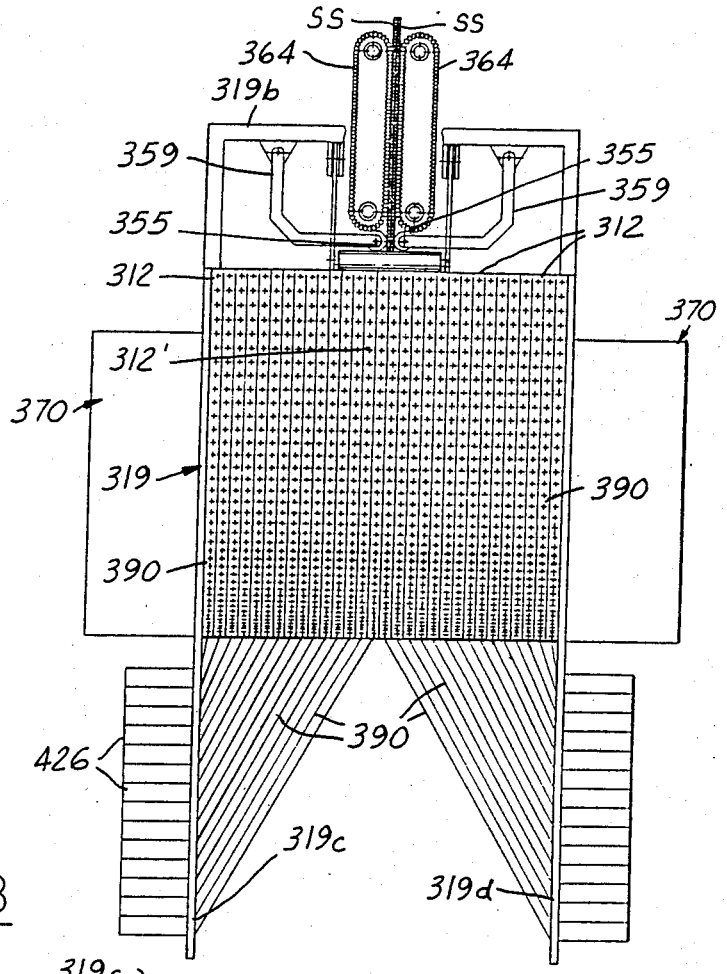
FIG. 7
FIG. 8
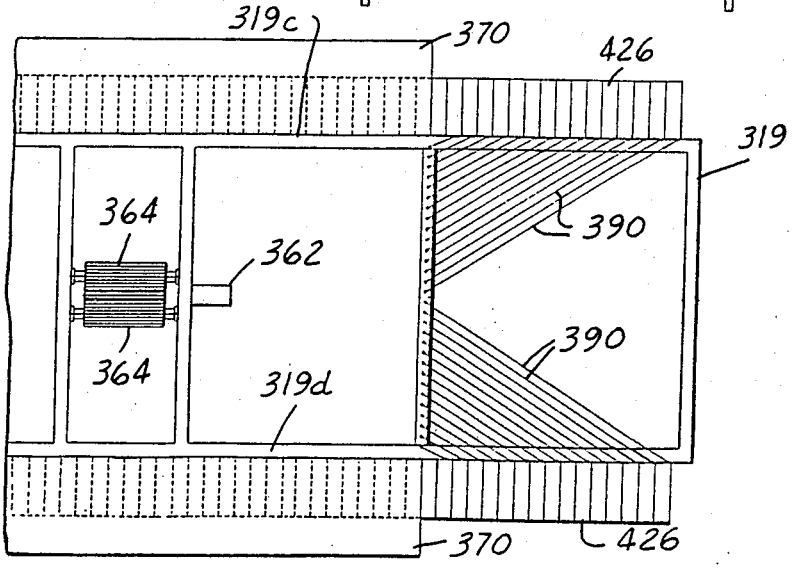

APPARATUS AND METHOD FOR BRAIDING FIBER STRANDS AND STUFFER FIBER STRANDS

FIELD OF THE INVENTION

This invention relates to apparatus and methods for intertwining fiber strands and stuffer fiber strands, more particularly, to an apparatus and method for braiding a three-dimensional article by intertwining fiber strands and stuffer fiber strands.

BACKGROUND OF THE INVENTION

The braiding of three-dimensional article preforms is known in the art. Existing apparatus for braiding three-dimensional article preforms move the fiber strands or yarns in Cartesian X-Y motions on a flat bed of tracks forming a pattern of columns and rows or in polar motions about a series of concentric flat circular tracks. The fiber strands typically are carried and moved simultaneously along the desired path by carrier members that move on a carrier plane or surface defined by the tracks in the column and row configuration or in the concentric circular configuration.

Illustrative of both types of apparatus are the Bluck U.S. Pat. No. 3,426,804 issued Feb. 11, 1969, and the Florentine U.S. Pat. No. 4,312,261 issued Jan. 26, 1982.

The Brown et al U.S. Pat. No. 4,621,560 issued Nov. 11, 1986, describes a Cartesian type of braiding apparatus having devices to tamp the columns of fiber carriers while the columns are blocked by an intermediate row of fiber carriers to effect proper alignment of the fiber carriers.

Technical article entitled "Application Of Through-The-Thickness Braiding Technology" by Richard T. Brown presented at 30th National SAMPE Symposium, Mar. 19–21, 1985, page 1509 describes braiding apparatus of the Cartesian and concentric circle types having flat planar carrier planes.

SUMMARY OF THE INVENTION

The invention contemplates an apparatus for intertwining a plurality of fiber strands and stuffer fiber strands including a plurality of carrier members movable on a flat Cartesian, flat concentric circular, quadratic, or other shape carrier surface formed by a plurality of movable side-by-side support members and including a plurality of means on the support members for dispensing axial stuffer fiber strands. The carrier members are disposed on the support members for movement therewith and for movement from one support member to another. Each stuffer fiber strand dispensing means moves with a respective support member but not from one support member to another. The carrier members are moved in respective paths on the carrier surface to intertwine the fiber strands carried thereon and the stuffer fiber strands that move only with the support members.

The means on the support members for dispensing axial stuffer strands may comprise a plurality of fiber guides disposed on each support member and a plurality of spools or supplies of stuffer fiber strands carried on each support member or disposed on a base that is stationary relative to the support members.

The invention also contemplates a method for forming an article by moving fiber strands in multiple directions transverse to one another on the carrier surface and moving stuffer fiber strands in opposite parallel directions on the carrier surface as the fiber strands are moved so as to intertwine them.

BRIEF DESCRIPTION OF THE DRAWINGS

FIG. 1 is a schematic perspective view of the apparatus of the invention.

FIG. 2 is a partial elevation taken in the direction of arrows 2—2 of FIG. 1.

FIG. 7 is an end elevation of FIG. 6 with some components of the apparatus deleted to show the take-up device in detail.

FIG. 8 is a partial top elevation of the apparatus of FIG. 6.

BEST MODE FOR CARRYING OUT THE INVENTION

Figure 3:
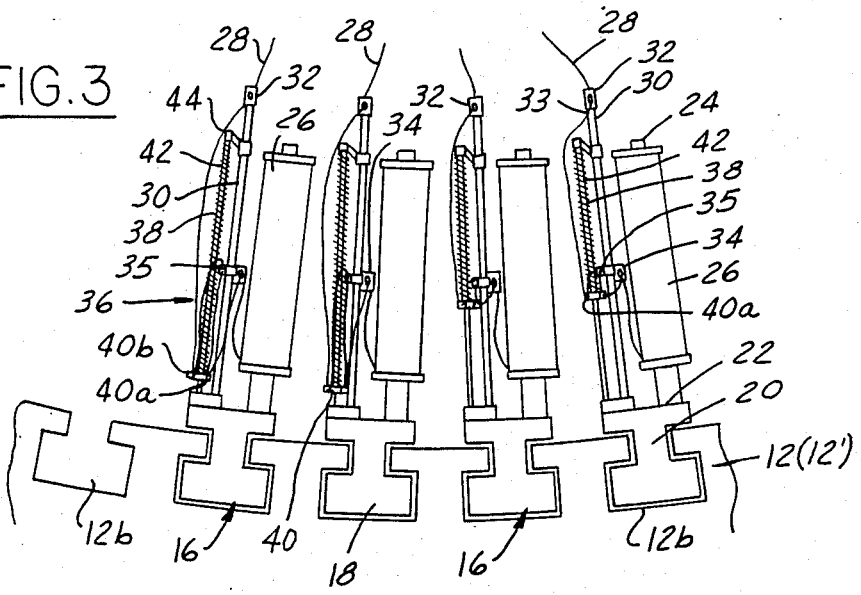
FIG. 3 is a partial side elevation of a portion a support member and carrier members thereon.

FIG. 1 illustrates in schematic form a braiding apparatus 10 in accordance with the invention. The apparatus includes a plurality of support members 12 arranged side-by-side for movement relative to one another by actuators 14 drivingly connected at opposite ends of each support member 12.

Each support member 12 has a partial cylindrical shape as is apparent. In particular, each support member includes an inner curved surface **12*a* that together with the other curved surfaces 12*a* collectively define a partial cylindrical carrier surface or plane 15. The carrier surface is illustrated as a cylindrical carrier surface but other quadratic carrier surfaces; i.e., a carrier surface defined by a quadratic equation can be used. Quadratic carrier surfaces include the cylinder illustrated, a parabolic cylinder and elliptic cylinder as well as surfaces whose shape approximates such quadratic carrier surfaces. Furthermore, carrier surface 15** may comprise flat Cartesian and flat concentric polar carrier surfaces; e.g., as illustrated in aforementioned U.S. Pat. Nos. 3,426,804 and 4,312,261.

For the cylindrical carrier surface 15 illustrated in FIG. 1, a plane therethrough extending parallel to the support members 12 and normal to the longitudinal axis Z of the cylindrical surface 15 includes a circular arc surface segment or portion having a common center that lies on the longitudinal axis Z.

Each support member 12 is actuated to move or reciprocate in increments in opposite directions (see arrow A) along a circular arc path during the braiding process. Actuators 14 are operatively connected to each end of each support member for this purpose. Actuators 14 may comprise known pneumatic, hydraulic or electrical actuators.

Referring to FIGS. 2 and 3, each curved surface **12*a* includes a plurality of generally T-shaped tracks 12*b* spaced circumferentially apart therealong. The T-shaped tracks 12*b* of one curved surface 12*a* align transversely or axially (in transverse or axial direction T that is parallel with the longitudinal axis Z of the cylindrical carrier surface 15) with the tracks 12*b* on adjacent support members 12 to form an elongated axial track segment TR. Tracks 12*b* are substantially parallel and spaced apart along the circular arc of all support members 12 by equal circumferential distances. Actuators 14 move the support members 12 in increments equal to this circumferential distance or spacing between tracks 12*b* or multiples thereof to effect transverse alignment of adjacent tracks 12*b***.

Disposed in the tracks **12*b* on the curved surface 12*b* are a plurality of fiber carrier members 16. Each fiber carrier member 16 includes a base 18 having a T-shaped portion 20 slidably received in its track 12*b*. Each carrier member also includes a platform 22 on the base. Platform 22 supports a rotatable spindle 24 having a supply or spool 26 of fiber strand 28 rotatable therewith. Platform 22 also supports a guide tube or rod 30 having an eyelet 32 on the innermost end 33 thereof. Fiber strand 28 from the supply spool is threaded through another eyelet 34 fixedly attached on guide rod 30. Each fiber strand 28** may include a single fiber strand or a bundle or yarn of multiple fiber strands of the same or different types.

Fiber strand 28 is threaded through a tensioner assembly 36 comprising a support rod 38 extending parallel with guide rod 30. Mounted for movement back and forth along the longitudinal axis of support rod 38 is fiber strand carrier guide 40 having free wheeling pulleys **40*a*,40*b* (shown schematically). Guide 40 is biased downwardly along the axis of rod 38 by coil spring 42. Coil spring 42 is disposed between guide 40 and cap 44 on the innermost end of rod 38 for this purpose. Fiber strand 28 extends from eyelet 34 to pulley 40*a* back to a pulley 35 (shown schematically) rotatably supported on the guide rod 30 and then back to pulley 40*b* on carrier guide 40. From pulley 40*b*, the strand extends to and passes through guide eyelet 32. Each fiber strand 28 extends from its respective eyelet 32 to optional fiber gathering device 50 disposed near or at a common consolidation point P above the quadratic carrier surface 15 defined by curved surfaces 12*a*. The consolidation point P lies on the axis Z of the cylindrical carrier surface 15 and is axially positioned over the central support member 12' in a vertical center plane therethrough. Tensioner assembly 36 is shown compressed for the two right hand assemblies 36 and relaxed for the two left hand assemblies 36 in FIG. 3**.

As best seen in FIG. 1, each fiber strand 28 extends along a radial axis of the cylindrical carrier surface and intersects the other fiber strands at the common consolidation point P above the same central support member 12'. Fiber carrier members 16 are shown schematically in FIG. 1.

As a result of the guide eyelets 32 on central support member 12' being positioned on substantially the same circular arc relative to and spaced from the carrier surface 15, the radial distance R from each eyelet 32 to common consolidation point P is substantially equal for the carrier members 16 on central support member 12' in FIG. 1 since the consolidation point P corresponds to a center point of the circular arc defined by the guide eyelets 32 and the arcuate segment (circular arc) of support member 12' in the vertical center plane containing the consolidation point P.

For the support members 12 immediately adjacent to central support member 12' on opposite sides thereof, the guide eyelets on the carrier members 16 of the adjacent support member will be equidistant from common centers lying on the axis of the cylindrical carrier surface 15, although at a slightly greater axial distance from the consolidation point P than the guide eyelets of carrier members on support member 12' as a result of the transverse or axial displacement of the adjacent support member from the vertical center plane containing common consolidation point P. Thus, the radial length of fiber strands on each support member adjacent support member 12' is progressively greater the farther the respective support member is positioned transversely or axially from the side of support member 12'. But the fiber strands 28 extending from carrier members on each such support member are of substantially the same radial length relative to a common center of that support member lying on axis Z. By making the support member, 12,12' as narrow as possible in the transverse or axial direction T and by providing a relatively large radius R and quadratic shape for carrier surface 15, the axial displacement of the support members adjacent central support member 12' can be relatively minimized such that the guide eyelets 32 on all the support members are generally, but not exactly, equidistant from common and consolidation point P. As a result, the radial lengths of all fiber strands 28 are generally, but not exactly, the same regardless of the position of their carrier members 16 on the cylindrical carrier surface 15 defined by the support members 12. As a result, the difference between distances from the carrier members to the common consolidation point P can be minimized regardless of the location of the carrier members on the carrier plane and the rewinding capacity of the fiber tensioner assemblies 35 is minimized. This, in turn, minimizes complexity of the fiber tensioner assemblies including guide rod 30, eyelets 32,34, coil spring 42 and cap 44 which assemblies provide the desired fiber tension between the take-up device 60 and spools 26.

As mentioned hereinabove, take-up device 60 withdraws the intertwined and gathered fiber strands from spools 26 through optional gathering device 50. Tensioner assemblies 36 function to accommodate varying withdrawal forces exerted by take-up device 60 to prevent the fiber strands from breaking or being subjected to excessive tension force along their longitudinal axes. The take-up device is shown as a rotatable wheel 61 driven by electrical motor 62 for drivingly engaging the braided preform PF as it exits the consolidation point P. Other known take-up devices can be used in the invention.

Gathering device 50 comprises a circular forming or consolidating eyelet for controlling the compactness or tightness of the braid of fiber strands 28. Other known gathering devices can be used and the use of a gathering device is optional in the invention.

Referring to FIG. 2, other actuators 70, such as hydraulic, pneumatic or other types of actuators, are provided adjacent the opposite axial ends of the cylindrical carrier surface to move the carrier members 16 in tracks **12*b* on one support member to another adjacent track 12*b* on another adjacent support member. The number of actuators 70 on each side of the carrier surface will be equal to the number of tracks 12*b* on the support members 12. Movement of the carrier members 16 from one track to another occurs in sequence with movement of the support members 12,12' relative to one another in direction A to cause each carrier member 16 to move in a predetermined path on the cylindrical carrier plane 15 until it returns to its original starting position. The travel of the carrier members along their respective paths on the cylindrical carrier surface causes the fiber strands to intertwine throughout the carrier surface to provide a three-dimensional braided article such as an article preform PF that can be subsequently impregnated with a plastic, metal or other matrix material around the fiber strands or used as a specialty fabric or article without the addition of a matrix material. The Bluck U.S. Pat. No. 3,426,804 illustrates typical paths of travel for carrier members to effect intertwining of fiber strands to form a braided article. Those skilled in the art will recognize that various paths of travel of the carrier member 16 on carrier surface 15 are possible. As the carrier members 16 move on the carrier surface 15, fiber strands 28 are intertwined and withdrawn from supply spools 26 by take-up device 60**.

Figure 4:
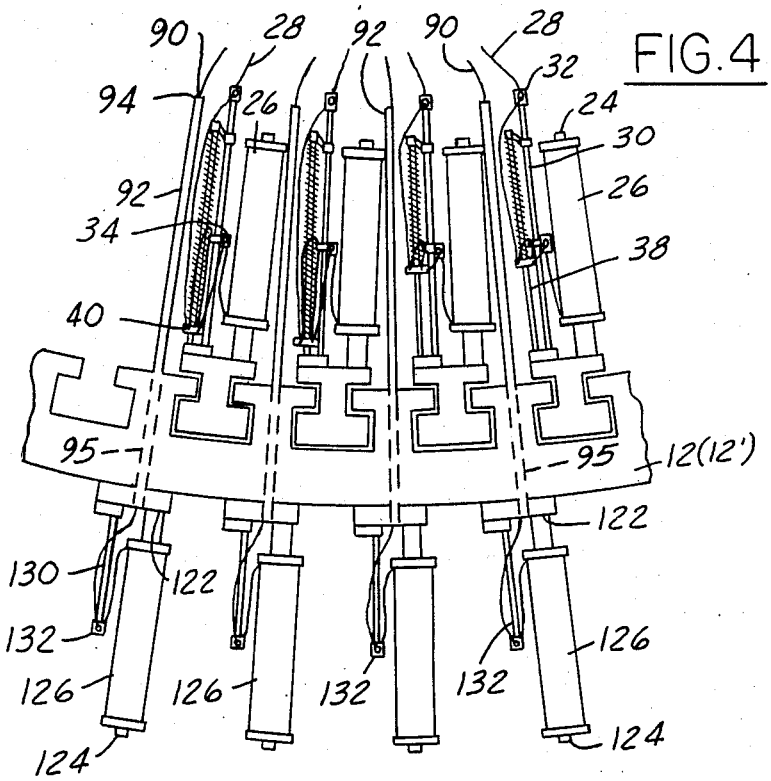
FIG. 4 is a similar view to FIG. 3 with the addition of stuffer fiber strands and spools carried on the support member.
Figure 5:
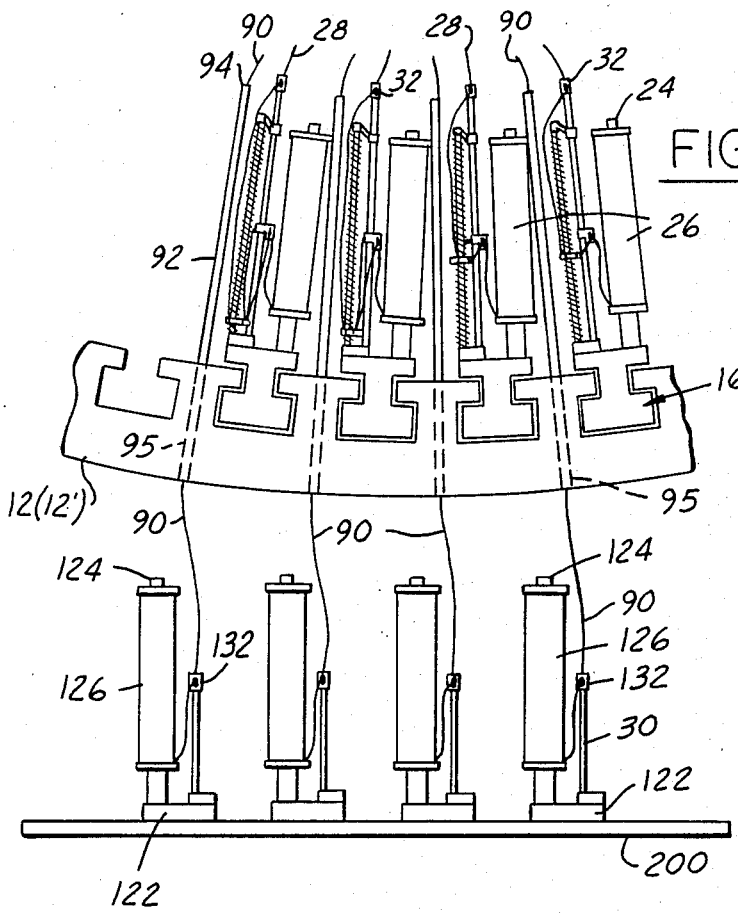
FIG. 5 is a similar view to FIG. 3 with the addition of stuffer fiber spools mounted on a stationary base and fiber guides on the support member through which stuffer fiber strands are dispensed from the spools.

FIGS. 4 and 5 illustrate specific embodiments of the invention wherein like features are represented by like reference numerals. In these embodiments, axial stuffer fiber strands 90 are dispensed from support members 12,12' simultaneously with fiber strands 28 from carrier members 16. In each figure, the stuffer fiber strands 90 extend through a respective passage 95 in the support members and through a respective guide tube 92 affixed on the support member and extending parallel with guide rod 30. Each guide rod 92 has an innermost outlet end 94 generally coincident with eyelets 32 in radial position from the cylindrical carrier surface 15. Guide tube 92 is affixed to surface **12*a*** for movement with the respective support member.

In FIG. 4, a plurality of rotatable spindles 124 and guide rods 130 like those described hereinabove on carrier members 16 are disposed on platforms 122 attached fixedly to the underside of each support member 12. A spool 126 of stuffer fiber strand 90 is carried on and rotatable with each spindle 124.

Stuffer fiber strands 90 are payed off spools 126 through a respective guide eyelet 132.

It is apparent that the stuffer fiber strand 90 moves in opposite parallel directions (arrow A) with its respective support member 12 and does not move independently of the support member as the carrier members 16 do to effect intertwining of the fiber strands. Stuffer fiber strands 90 only move with their respective support member 12 as it is positioned in various positions along the circular arc (arrow A) contained within the cylindrical carrier surface 15. In contrast, the carrier members 16 are moved along their respective paths by movement of the individual support members and by movement of the carrier members from one support member to another across carrier surface 15 to effect intertwining of the fiber strands 28 on carrier members 16 and the stuffer fiber strands 90 supplied from guide tubes 92.

In FIG. 5, the platforms 122 are mounted on an independent base member 200 beneath the support members and are always stationary. As shown, rotatable spindles 124 and guide rods 130 are mounted on the platforms 122 and thus do not move with the support members 12. Spools 126 will pay out stuffer fiber strands 90 during the braiding process as the carrier members 16 are moved in respective paths to effect intertwining of fiber strands 28 and stuffer fiber strands 90. A take-up device (not shown in FIG. 5) withdraws the fiber strands 28 and stuffer fiber strands 90 during the braiding process.

The stuffer fiber strands 90 extend through passages 95 in support members 12 and through respective guide tubes 92 as they do in FIG. 4 and are withdrawn out of outlet end 94 of the respective guide tube. Outlet ends 94 are generally coincident in radial position with guide eyelets 32.

In the embodiments of FIGS. 4 and 5, the tension in stuffer fiber strands 90 will be generally equal or constant from one stuffer fiber strand to the next regardless of their position on the cylindrical carrier surface and further will be generally equal to the tension in fiber strands 28 for the same reasons as explained above for fiber strands 28; i.e., the stuffer fiber strands 90 and fiber strands 28 are generally, but not exactly, equal in radial length as a result of the relatively large radius and shape of cylindrical carrier surface 15 and the generally equidistant relation of all guide eyelets 32 and outlet ends 94 from common consolidation P.

FIGS. 6–17 illustrate a preferred apparatus of the invention for intertwining a plurality of fiber strands and stuffer fiber strands to form a three-dimensional braided article or preform. The apparatus includes a plurality of support members 312 arranged side-by-side for movement relative to one another by a pair of actuators 314 connected at opposite ends of each support member 312.

Figure 12:
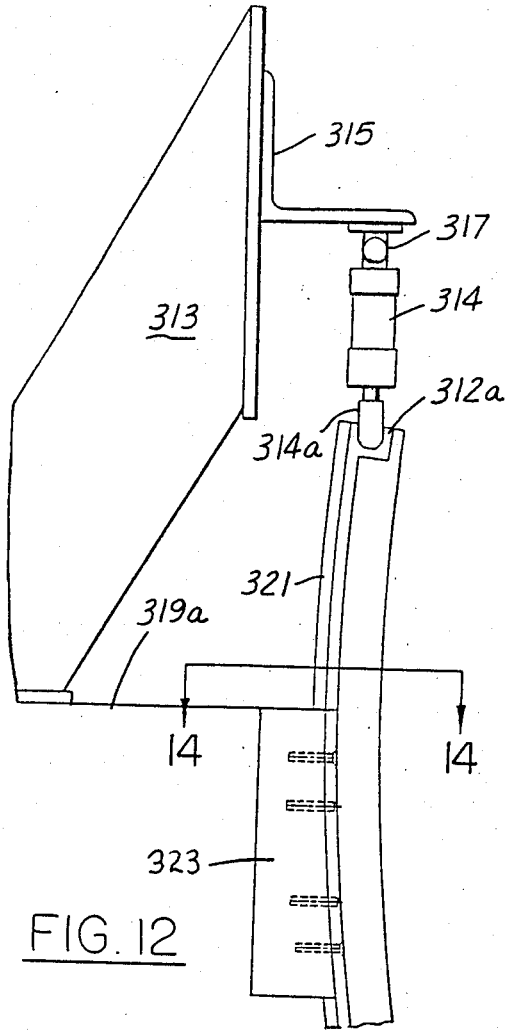
FIG. 12 is an enlarged elevation of a portion of FIG. 6.

The opposite ends **312*a* of each support member are flexibly supported from inclined support frame 313 by the actuators 314, which are shown as fluid cylinders, e.g., see FIG. 12. In particular, each support frame 313 includes an L-shaped bracket 315 fastened thereto and from which one end of the cylinder actuator 314 is pivotally suspended by pin 317. The plunger 314*a* of each cylinder actuator 314 is pivotally connected to ends 312*a*** of each track.

Inclined support frame 313 is affixed on a larger base frame 319, in particular on a horizontal member **319*a*** of the base frame.

Figure 13:
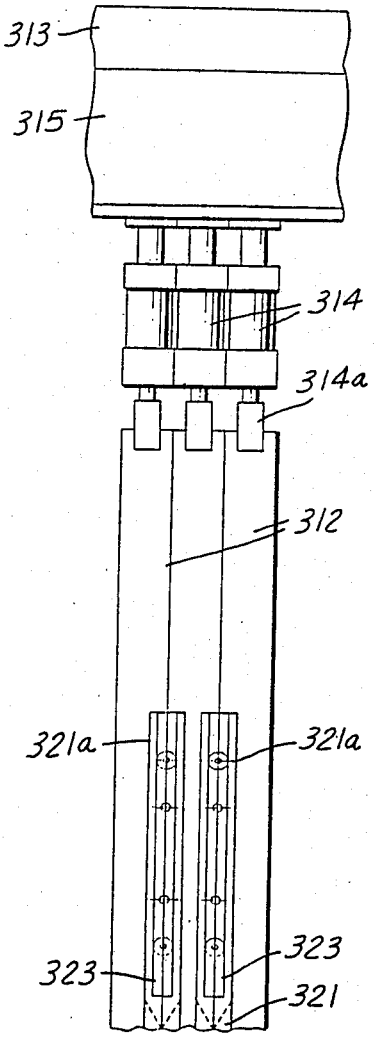
FIG. 13 is a partial elevation in the direction of arrow 13 of FIG. 12.
Figure 14:
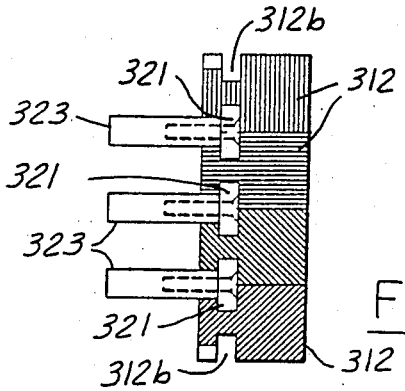
FIG. 14 is a sectional view taken along lines 14—14 of FIG. 12.

The support members 312 are slidably disposed on a plurality of support splines 321 having opposite ends **321*a* fastened to shanks 323 by the machine screws and dowel pins shown, FIGS. 12–14. Shanks 323 in turn are affixed on horizontal member 319*a*** of the base frame.

Figure 11:
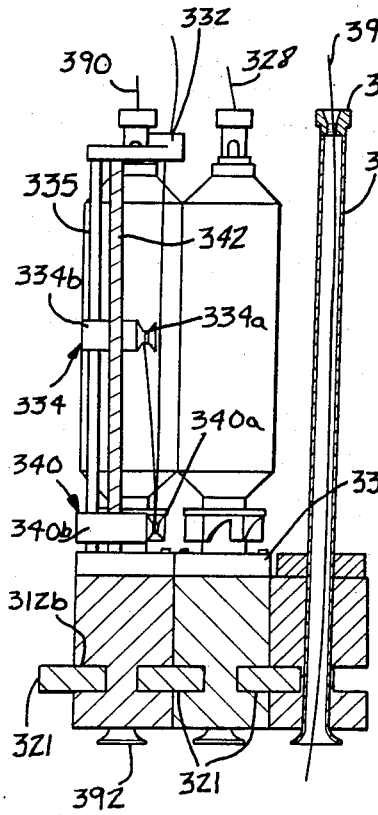
FIG. 11 is a partial elevation in the direction of arrow 11 in FIG. 9.
Figure 10:
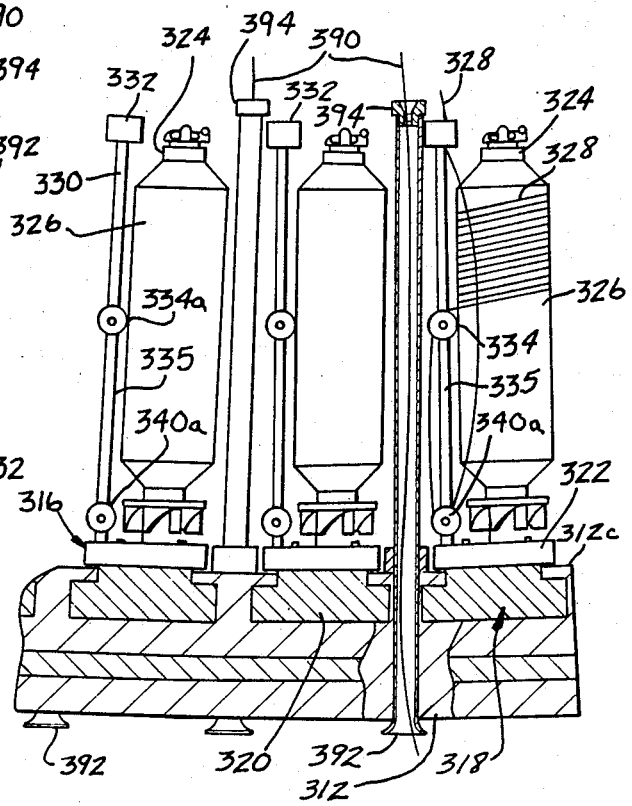
FIG. 10 is a partial elevation in the direction of arrow 10 in FIG. 9.
Figure 16:
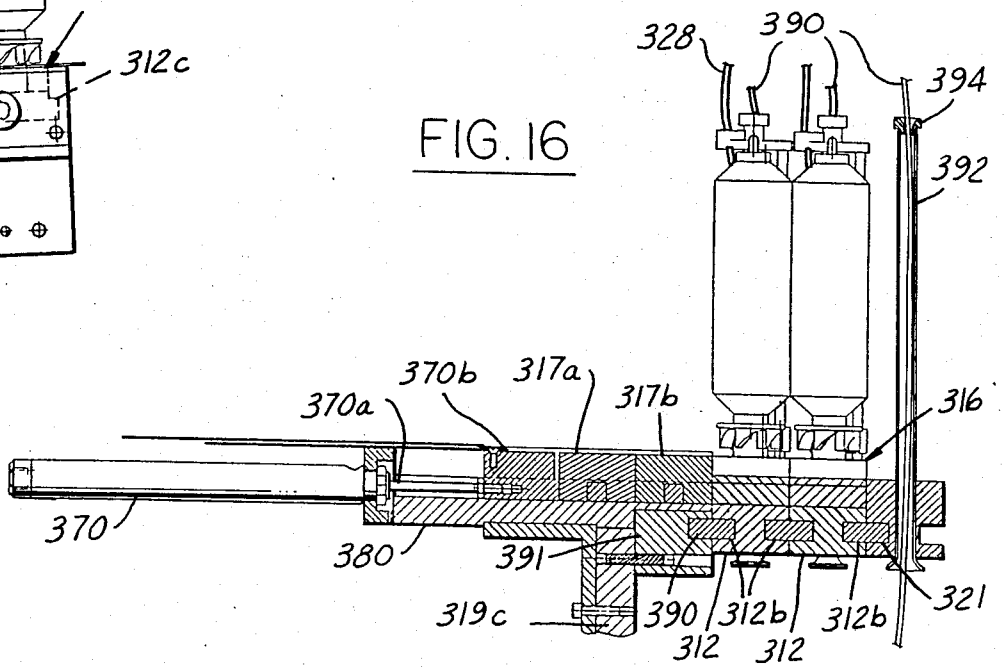
FIG. 16 is a sectional view taken along lines 16—16 of FIG. 15.
Figure 17:
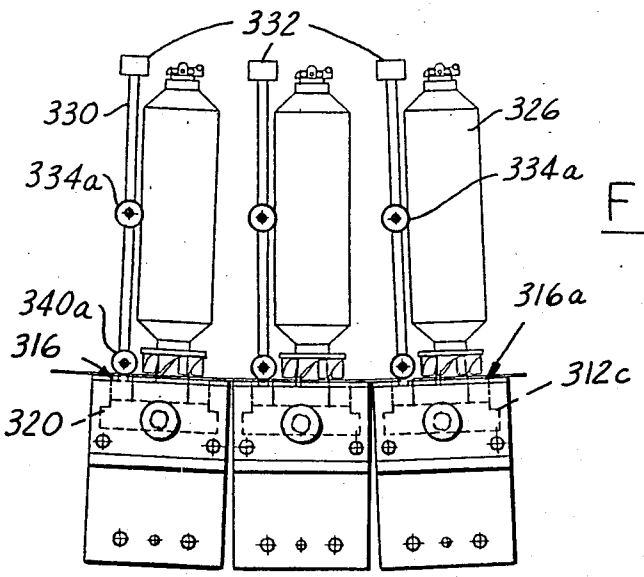
FIG. 17 is a partial elevation in the direction of arrow 17 in FIG. 15.

As shown best in FIGS. 11, 14 and 16, adjacent support members 312 are slidably mounted the support spline 321 therebetween and the support members are provided with lateral grooves **312*b* slidably received on opposite sides of a respective support spline 321** therebetween.

Each support member 312 and support spline 321 has a partial cylindrical shape as is apparent. The inner curved surfaces of the support member 312 collectively define a partial cylindrical carrier surface or plane 415 having a common consolidation point P.

Each curved support member 312 includes a plurality of T-shaped tracks 312*c* spaced circumferentially apart along its length. The T-shaped tracks 312*c* of one support member align transversely or axially with similar tracks 312*c* on adjacent support members to form an elongated axial track segment TR. Tracks 312*c* are spaced apart along the circular arc of all support members 312 by equal circumferential distances. Actuators 314 move the support members 312 in increments equal to this circumferential spacing between tracks or multiples thereof to effect transverse alignment of adjacent tracks 312*c*.

Disposed in the tracks 312*c* on the curved support members 312 are a plurality of fiber strand carrier member 316. Each fiber carrier member 316 includes a base 318 having a T-shaped portion 320 slidably received in its track 312*c*. Each carrier member also includes a platform 322 on the base. Platform 322 supports a rotatable spindle 324 having a supply or spool 326 of fiber strand 328 rotatable thereon. Platform 322 also supports a guide tube or rod 330 having an eyelet 332 on the innermost end thereof.

Fiber strand 328 from the supply spool is threaded through a free-wheeling pulley assembly 334 mounted in fixed position on another support rod 335 that extends parallel with guide rod 330. Fiber strand 328 is threaded from pulley 334 to a movable pulley assembly 340 slidably mounted on support rod 335. A coil spring 342 is disposed on the guide rod 330 to bias pulley 340 downwardly along the axis of the guide rod.

Pulley assembly 334 includes free-wheeling pulley 334*a* and shaft 334*b* which is fastened to support rod 335. Shaft 334*b* includes a pair of bores in which guide rod 330 and support rod 335 are received. Pulley assembly 340 includes free-wheeling pulley 340*a* and shaft 340*b* slidably mounted on guide rod 330 and support rod 335 and having a pair of bores as shown in which the guide rod and support rod are received. From pulley assembly 340, the fiber strand 328 is threaded through eyelet 332.

Each fiber strand 328 extends from its respective eyelet 332 to optional fiber gathering device 350 disposed near the common consolidation point P of the carrier surface defined by the support members. The fiber gathering device 350 includes a first pair of rollers 353 and second pair of rollers 355. Rollers are suspended by pivotal arms 357 adjacent the minor sides SL of the braided preform PF while rollers 355 are suspended by pivotal arms 359 adjacent the major sides SS of the preform to consolidate the fiber strands 328 to desired shape.

Figure 6:
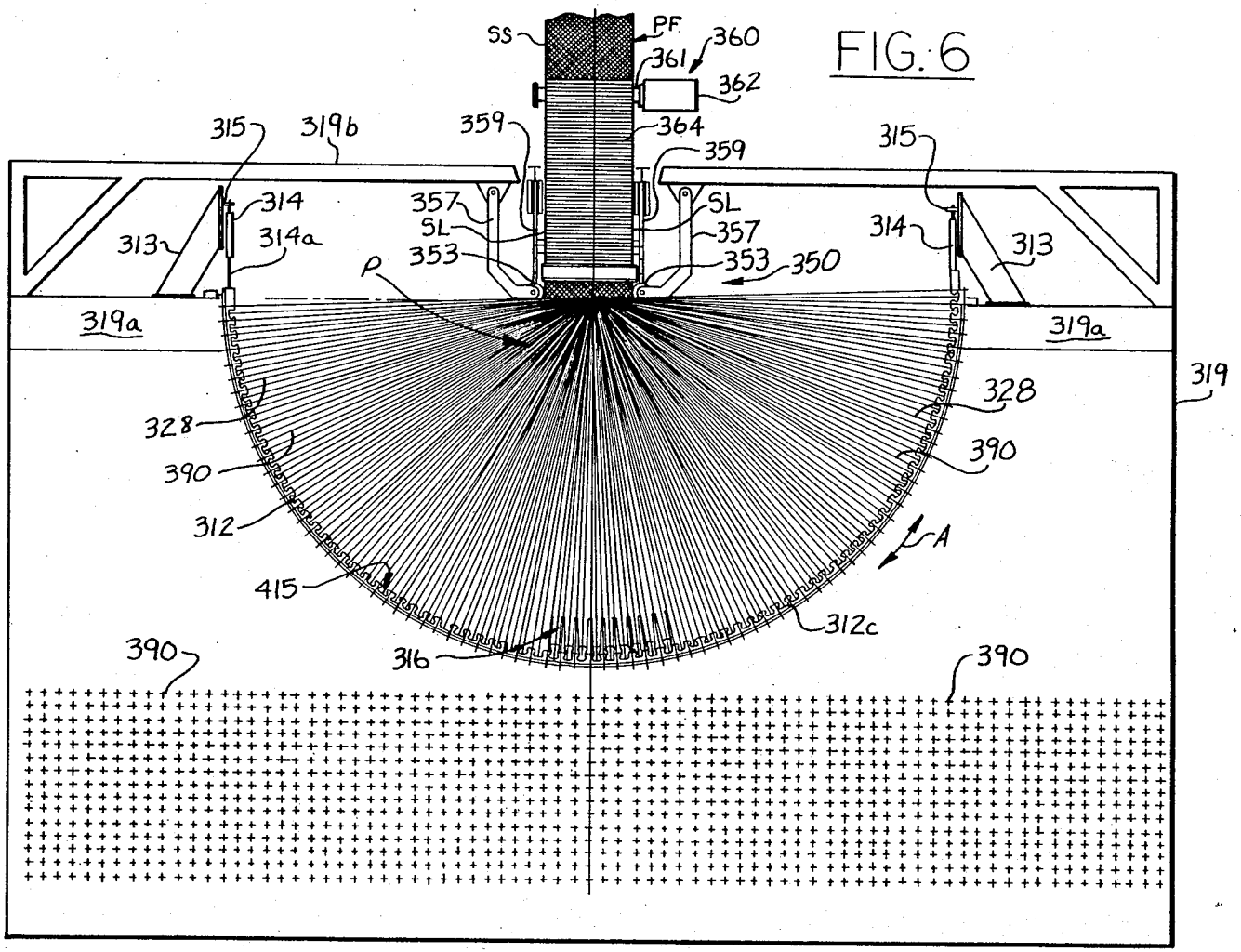
FIG. 6 is an elevation of support members intermediate the axial ends of the carrier surface of a preferred apparatus of the invention.
Figure 9:
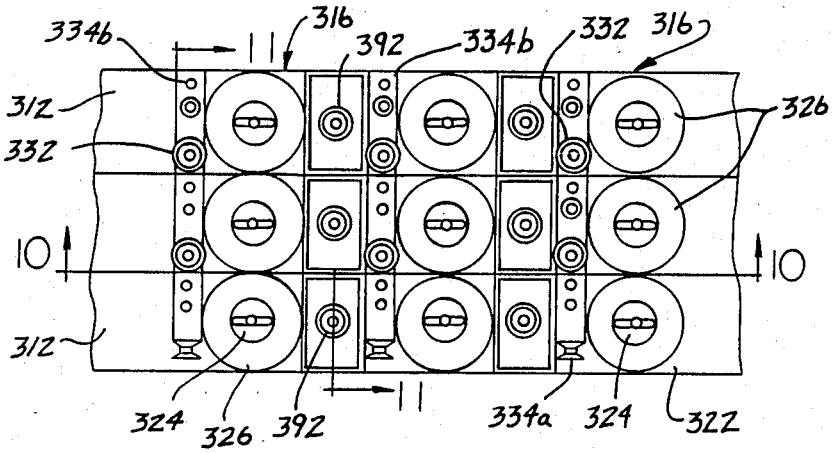
FIG. 9 is a partial top elevation of the flexible support members of FIG. 6.

Arms 357,359 are pivotally mounted on upper horizontal member 319*b* of the base frame 319 as shown in FIGS. 6 and 7.

A take-up device 360 in form of a pair of endless belts 364 engaging the major sides SS of the braided preform withdraw the intertwined and gathered strands from rollers 353,355. Belts 364 are driven by an output shaft 361 of electrical motor 362 and drivingly engage the major sides SS for moving the intertwined fiber strands away from the carrier surface.

As described above for the embodiment of FIGS. 1–5, by making the support members 312 as narrow as possible (in an axial or transverse direction T) and by providing a relatively large radius R and special shape (partial cylindrical) for the carrier surface, the axial displacement or offset of the support members adjacent central support member 312' can be relatively minimized such that the guide eyelets 332 on the support members are generally, but not exactly, equidistant from common consolidation point P. As a result, the radial lengths of all fiber strands 328 are generally, but not exactly, the same regardless of the position of their carrier members 316 on the carrier surface 315. The same advantages derive from this arrangement as expressed for the embodiment of FIGS. 1–5.

Figure 15:
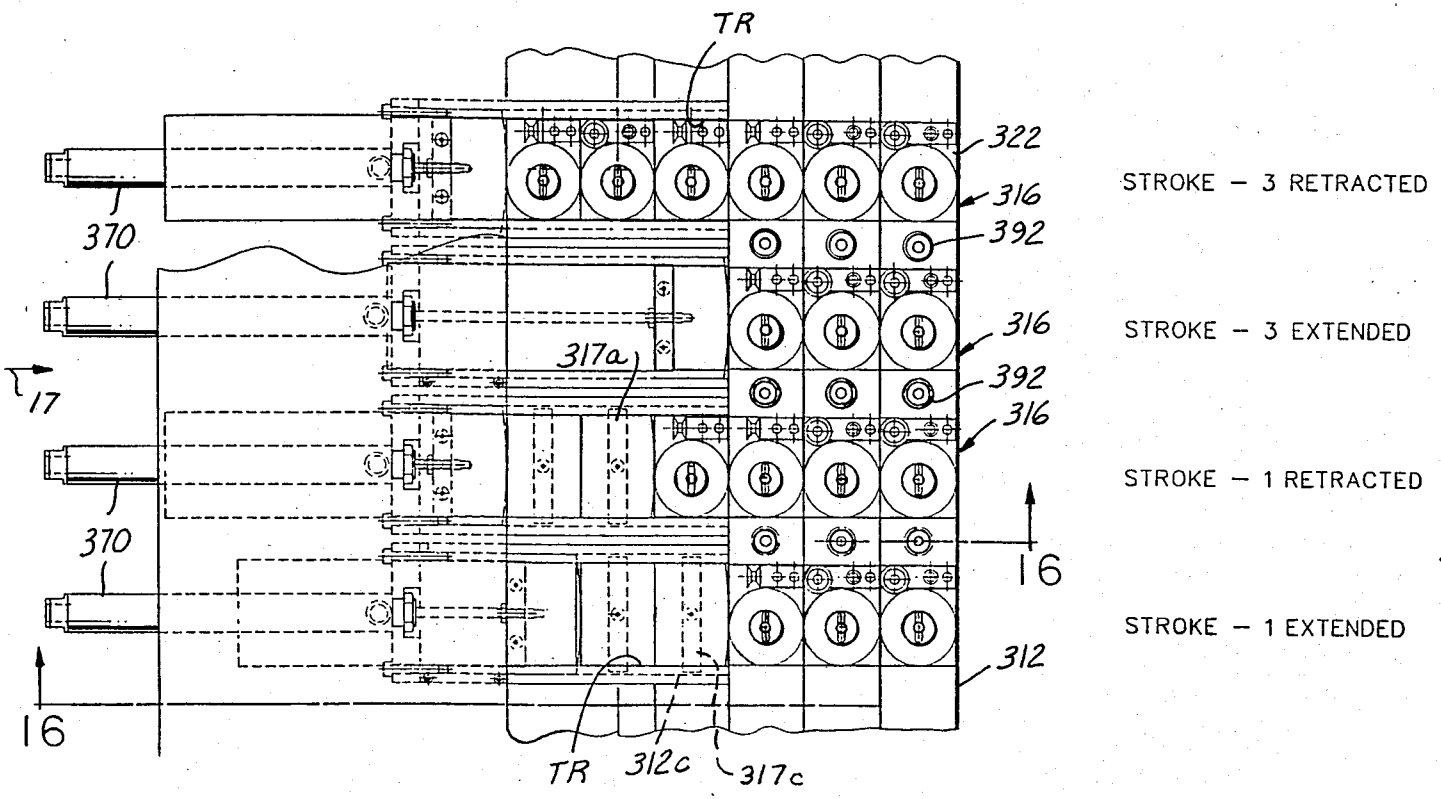
FIG. 15 is an enlarged partial top elevation of support members adjacent an axial end of the carrier surface of FIG. 6.

Referring to FIGS. 15–16, other actuators 370, such as hydraulic, pneumatic or other types of actuators, are provided adjacent the opposite axial ends of the cylindrical carrier surface 315 to move carrier members 316 in tracks 312*c* on one support member to another aligned adjacent track on an adjacent support member.

As in the embodiments of FIGS. 1–5 described above, the carrier members 316 are caused to move in predetermined paths on the carrier plane 315 until each returns to its original starting position. This movement is effected by movement of the carrier members from one track 315 to another by actuation of actuators 370 in sequence with movement of the support members 312 relative to one another in direction A.

Each actuator 370 includes a plunger 370*a* connected to a pusher member 370*b*. Pusher member 370*b* is moved to engage a first mock carrier member 317*a* which, in turn, engages a second mock carrier member 317*b*. The second mock carrier member engages and moves a real working carrier member 316. Actuator 370, pusher member 370*a*, and the mock carrier members are carried on support plate 380. The movable support members 312 on opposite axial sides of the carrier surface are movably disposed on end support splines 390. A mock support member 391 is disposed on the opposite side of the end support spline, FIG. 16, and is doweled to vertical member 319*c* or 319*d* of the base frame.

Movement of the carrier members causes the fiber strands 328 to intertwine to provide a three-dimensional braided article or preform PF. As the carrier members move on the carrier surface 315, the intertwined fiber strands are withdrawn from the supply spools 326 and carrier surface by take-up device 360.

Stuffer fiber strands 390 are also dispensed from spools 426 that are rotatably mounted on base frame 319, FIGS. 6–8. In particular, spools 426 are mounted on opposite vertical side members 319*c*,319*d* of the base frame.

The stuffer fiber strand 390 from each spool 426 extends to a respective guide tube 392 disposed on and extending through the support members 312. The stuffer fiber strand 390 exits the guide tube 392 through a guide outlet ring 394 which are generally coincident in radial position with eyelets 332.

The stuffer fiber strands 390 move in the direction of arrow A with the respective support member 312 and do not move independently relative to the support member as the carrier members 312 do. Stuffer fiber strands 390 only move with their support member 312 as it is positioned in various positions along the circular arc contained within the cylindrical carrier surface 315. In contrast, the carrier members 316 are moved with their respective support member and from one support member to another to transverse the carrier surface in a particular path to effect intertwining of the fiber strands 328 on the carrier members and stuffer fiber strands 390 supplied from guide tubes 392.

Copending U.S. patent application Ser. No. 191,434, now U.S. Pat. No. 4,922,798 entitled "Apparatus And Method For Braiding Fiber Strands" and filed on even date herewith in the names of Thomas J. Ivsan et al, of common assigned herewith, describes braiding apparatus of the type described above.

Figure 18:
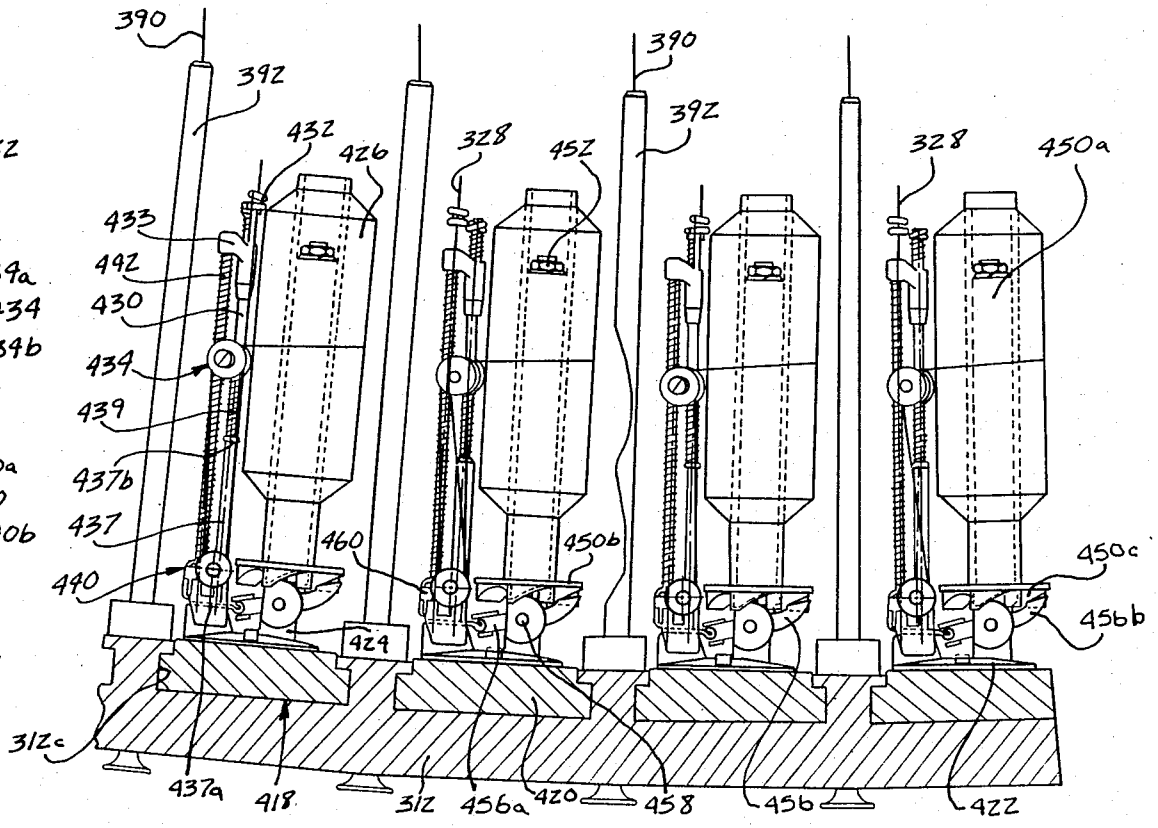
FIG. 18 is a view similar to FIG. 10 of a different embodiment of the invention.
Figure 19:
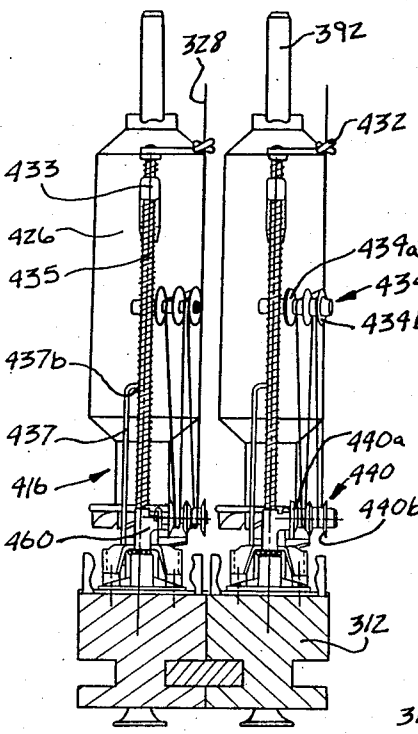
FIG. 19 is a view similar to FIG. 11 of the embodiment of FIG. 18.

FIGS. 18–19 illustrate preferred fiber carrier members 416 for use with the apparatus described above. In particular, each fiber carrier member 416 includes a base 418 having a T-shaped by a set screw on the base. Platform 422 supports affixed spindle 424 having a spool 426 of fiber strand 328 thereon. Platform 422 also supports a guide rod 430 having a coil eyelet 432 on the innermost end thereof.

Fiber strand 328 from each supply spool 426 is threaded through a first inner free-wheeling pulley **434*a* of an upper pulley assembly 434 and then through a first, inner free wheeling pulley 440*a* of a lower pulley assembly 440. The upper pulley assembly 434 is fixed in position on the rod 430 whereas the lower pulley assembly 440 is slidable on guide rod 435 and biased downwardly by coil spring 442. The coil spring 442 is held between spring retainer cap 433 and a braider stop 460 on the rod 435. The fiber strand 328 is threaded from the first, inner pulley 440*a* to the second, outer free-wheeling pulley 434*b* of the upper pulley assembly 434 and then through the second, outer pulley 440*b* of the lower pulley assembly 440. From the second, outer pulley 440*b*, the fiber strand 328 is threaded through the coil eyelet 432 toward the gathering device 350 shown in FIG. 6**.

Each spool 426 is carried for rotation on a spool holder 450 having a support shaft **450*a* and a platform 450*b* having a plurality of peripheral ratchet teeth 450*c*. A threaded nut 452 holds the spool holder 450 on the spindle 424**.

The guide rod 430 includes at its lower end a pawl lift member 437 slideable on the rod 430 and having a bent end **437*a*. Bent end 437*a* is received in a channel 456*a* of a pawl member 456 pivotally mounted on the spindle 424 by pivot shaft 458. A coil spring 439 biases the pawl lift member 437 downwardly on the rod 430. The pawl member 456 includes a pawl end 456*b* that is adapted to engage with the ratchet teeth 450*c* on the spool holder and prevent rotation of the spool holder 450 and spool 426 thereon. The pawl end 456*b* is disengaged from the ratchet teeth 450*c* when the lower pulley assembly 440 is raised on the guide rod 435 and the braider stop 460 engages a pawl lift flange 437*a* on the pawl lift member 437. The braider stop 460 moves with the lower pulley assembly 430 upwardly on the guide rods 430** during braiding.

When the braider stop 460 engages and lifts the pawl lift flange **437*b* the pawl member 456 is pivoted in a direction to disengage the pawl end 456*b***.

When the braider stop 460 engages and lifts the pawl lift flange **437*b* the pawl member 456 is pivoted in a direction to disengage the pawl end 456*b* thereof from the ratchet teeth 450*c*. Such disengagement permits rotation of the spool holder 450 and the spool 426 of fiber strand 328 to pay out a length of fiber strand. The length of fiber strand payed out is controlled by the pawl member 456 engaging the next ratchet tooth 450*c*. Coil spring 439 on the rod 430 biases the pawl lift flange 437*b* on the rod 430 downwardly to cause the pawl member 456 to engage the next ratchet tooth 450*c***.

Stuffer fiber strands 390 are dispensed from guide tubes 392 as in the embodiments described hereinabove.

While the invention has been described in terms of specific preferred embodiments thereof, it is not intended to be limited thereto but rather only to the extent set forth hereafter in the claims.

We claim:

1. An apparatus for forming an article by intertwining a plurality of fiber strands and stuffer fiber strands, comprising:

(a) a plurality of movable support members arranged side-by-side to form a carrier surface, (b) a plurality of carrier members movably disposed on the carrier surface for carrying a plurality of fiber strands for intertwining, (c) means for moving the support members relative to one another, (d) means for moving the carrier members from one support member to another, (e) a plurality of means disposed on the support members and movable therewith for dispensing a respective stuffer fiber strand from each dispensing means as said support members move for intertwining with said fiber strands, and (f) take-up means for moving the intertwined fiber strands and stuffer fiber strands away from the carrier surface.

2. The apparatus of claim 1 wherein the means for dispensing the stuffer fiber strand each comprises a guide member on each support member to dispense a respective stuffer fiber strand.

3. The apparatus of claim 2 wherein the means for dispensing the stuffer fiber strand each includes a supply of stuffer fiber strand disposed on a respective support member for supply to a respective guide member.

4. The apparatus of claim 2 wherein the means for dispensing the stuffer fiber strand each includes a supply of stuffer fiber strand mounted on a base independent of the support member for supply to a respective guide member.

5. The apparatus of claim 4 wherein the support members are movably disposed on said base.

6. The apparatus of claim 5 wherein said base includes spaced apart end walls adjacent opposite ends of the carrier surface and the supplies of stuffer fiber strand are disposed on the end walls.

7. The apparatus of claim 1 wherein the carrier surface is a quadratic surface.

8. The apparatus of claim 7 wherein the quadratic surface is a partial cylinder.

9. A method for forming an article comprising:

(a) moving a plurality of fiber strand carrier members in multiple directions transverse to one another on a carrier surface to intertwine the fiber strands, (b) moving a plurality of stuffer fiber strands on the carrier surface as the fiber strand carrier members are moved so as to intertwine said stuffer fiber strands and said fiber strands, and (c) moving the intertwined fiber strands and stuffer fiber strands away from the carrier surface.

10. The method of claim 9 including moving the fiber strand carrier members and stuffer fiber strands such that said fiber strands and stuffer fiber strands are generally equidistant from a common consolidation point spaced from the carrier surface.

11. An apparatus for forming an article by intertwining a plurality of fiber strands and stuffer fiber strands, comprising:

(a) a plurality of movable support members arranged side-by-side to form a carrier surface, (b) a plurality of carrier members movably disposed on the carrier surface for carrying a plurality of fiber strands for intertwining, (c) means for moving the support members relative to one another, (d) means for moving the carrier members from one of said support members to another of said support members, (e) a plurality of means disposed on each support member and movable therewith for dispensing a respective stuffer fiber strand from each dispensing means as each support member moves for intertwining with said fiber strands, and (f) take-up means for moving the intertwined fiber strands and stuffer fiber strands away from the carrier surface.

12. A method for forming an article comprising:

(a) moving a plurality of fiber strand carrier members in multiple directions transverse to one another on a carrier surface defined by relatively movable side-by-side support members, including moving the support members relative to one another and moving said carrier members from one support member to another, (b) dispensing a fiber strand from each fiber strand carrier member as it moves on said carrier surface, (c) dispensing a plurality of stuffer fiber strands from each support member as it moves such that the stuffer fiber strands are moved on the carrier surface as the fiber strand carrier members are moved so as to intertwine said stuffer fiber strands and said fiber strands, and (d) moving the intertwined fiber strands and stuffer fiber strands away from the carrier surface.

* * * * *

UNITED STATES PATENT AND TRADEMARK OFFICE

CERTIFICATE OF CORRECTION

PATENT NO. : 4,984,502
DATED : January 15, 1991
INVENTOR(S) : Raymond G. Spain, et. al.

It is certified that error appears in the above-indentified patent and that said Letters Patent is hereby corrected as shown below:

On the Title page, item [57], line 10, delete "abother" and insert --another-- therefor.

Column 2, line 9, after "portion" insert --of--.

Column 6, line 64, after "mounted" insert --on--.

Signed and Sealed this

Seventeenth Day of August, 1993

Bruce Lehman

*Attest:*

BRUCE LEHMAN

*Attesting Officer*

*Commissioner of Patents and Trademarks*